US006840807B2

(12) United States Patent
Ooya et al.

(10) Patent No.: US 6,840,807 B2
(45) Date of Patent: Jan. 11, 2005

(54) CARD CONNECTOR

(75) Inventors: Masaaki Ooya, Yokohama (JP); Kiyoshi Abe, Tokyo (JP); Yasuhiro Ono, Yokohama (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 10/253,721

(22) Filed: Sep. 25, 2002

(65) Prior Publication Data

US 2003/0064627 A1 Apr. 3, 2003

(30) Foreign Application Priority Data

Sep. 28, 2001 (JP) ..... 2001-303471

(51) Int. Cl.[7] ..... H01R 24/00
(52) U.S. Cl. ..... 439/630; 439/607
(58) Field of Search ..... 439/630, 607

(56) References Cited

U.S. PATENT DOCUMENTS 5,823,828 A * 10/1998 Bricaud et al. ..... 439/630
5,906,516 A * 5/1999 Sato et al. ..... 439/630
6,007,381 A * 12/1999 Ando et al. ..... 439/607
6,050,857 A * 4/2000 Lok ..... 439/630
6,099,353 A * 8/2000 Wu ..... 439/630

* cited by examiner

*Primary Examiner*—Dean A. Reichard
*Assistant Examiner*—Anton Harris
(74) *Attorney, Agent, or Firm*—Finnegan, Henderson, Farabow, Garrett & Dunner, LLP

(57) ABSTRACT

A card connector including a base and a sheet metal cover combined with the base to form a flat hollow housing. Also, a plurality of pin-like elongate terminal members extend from an end and lateral walls of the sheet metal cover to be integral with the base, whereby a structure durable against an impact imposed when the housing falls is obtainable as well as the height of the card connector becomes smaller as the market requires.

25 Claims, 7 Drawing Sheets

CARD CONNECTOR

This application is based on patent application No. 2001-303471 filed on Sep. 28, 2001 in Japan, the content of which is incorporated herein by reference.

BACKGROUND OF THE INVENTION

1. Field of the Invention

The present invention relates to a card connector attached to an electronics apparatus or an information terminal device such as a portable phone, a telephone, PDA (personal digital assistance), a portable audio or a camera, particularly to a card connector in which a card such as an IC card, SD card or SIM card is to be inserted.

2. Description of the Related Art

Recently, in an electronics apparatus or an information terminal device such as a portable phone, a telephone, PDA (personal digital assistance), a portable audio or a camera, an IC card, SD card or SIM card in which an IC part called as an IC chip is incorporated has been increasingly used, and therefore a card connector for inserting such the IC card, SD card or SIM card has been widely required.

Also, there is a card elongated in the card-inserting direction and attached with an antenna at a tip end thereof to be usable in a wireless manner. Such a card is used with the antenna projected out from a housing of the card connector. If the housing from which the antenna is projected out is unintentionally fell down and the card collides with a concrete portion, a very large impact is applied to the card connector to often cause a breakage of the same.

The card connector is required as a general market demand to have a small height as a whole and a sufficient strength. To achieve the required strength, a sheet metal cover is provided on a top surface of a base of the card connector. There is a similar requirement in a so-called reverse type IC card connector in which the IC card is used in a reversal manner. Accordingly, a small height of the card connector and a strength durable against the twist of the IC card are demanded and a metallic plate is used on a top surface of the card connector for achieving these requirements.

However, if such a card connector slips from a hand, a large impact is applied thereto to cause a breakage of the same. Further, if reinforcing the card connector to strengthen the same, there may be a problem in that the card connector becomes larger in size to increase a height thereof.

Accordingly, an object of the present invention is to solve the above-mentioned problems in the prior art by providing a card connector of a hollow flat housing formed of a base and a sheet metal cover, wherein pin-like elongate terminal members extend from an end wall and side walls of the sheet metal cover so that the cover is integral with the base to withstand the impact applied when the card connector falls and to reduce the height of the card connector as the market requires.

SUMMARY OF THE INVENTION

To achieve the above-mentioned object, a card connector of the present invention comprises a base and a sheet metal cover to be combined therewith to form a flat hollow housing, wherein a plurality of pin-like elongate terminal members are provided in the sheet metal cover so as to extend from an end and side walls of the sheet metal cover, so that the base and the sheet metal cover are integral with each other to have a strengthened structure durable against the falling impact as well as low in height as the market has required.

According to the card connector of the present invention, the sheet metal cover includes a flat cover body and lateral walls formed by bending opposite sides of the cover body, wherein the elongate terminal members extend outward from an end and the lateral walls of the sheet metal cover, whereby the base and the sheet metal cover are combined with each other to be an integral structure durable against an impact applied when the housing falls as well as low in height as the market has required.

Further, according to the card connector of the present invention, the sheet metal cover includes a flat cover body and lateral walls formed by bending opposite sides of the cover body, parts of the elongate terminal members extend through a molded portion of the base, whereby the base is reinforced integrally with the sheet metal cover and has a low height, which can be readily and inexpensively manufactured.

Furthermore, according to the card connector of the present invention, holes are provided in the molded portion of the base, into which the elongate terminal members are inserted, whereby the elongate terminal members are press-fit into the holes to assemble the base and the sheet metal cover with each other without any looseness.

According to the card connector of the present invention, the elongate terminal members are mounted to a printed circuit board to pass therethrough as DIP terminals, tip ends of which project outside and bonded by solder or lead-free material, whereby if the DIP terminals are press-fit, there is no looseness between the molded portion of the base and the sheet metal cover and no deformation in the molded portion to result in favorable mounting of the printed circuit board.

The above and other objects, effects, features and advantages of the present invention will become more apparent from the following description of the embodiments thereof taken in conjunction with the accompanying drawings.

DETAILED DESCRIPTION OF PREFERRED EMBODIMENTS

Figure 1:
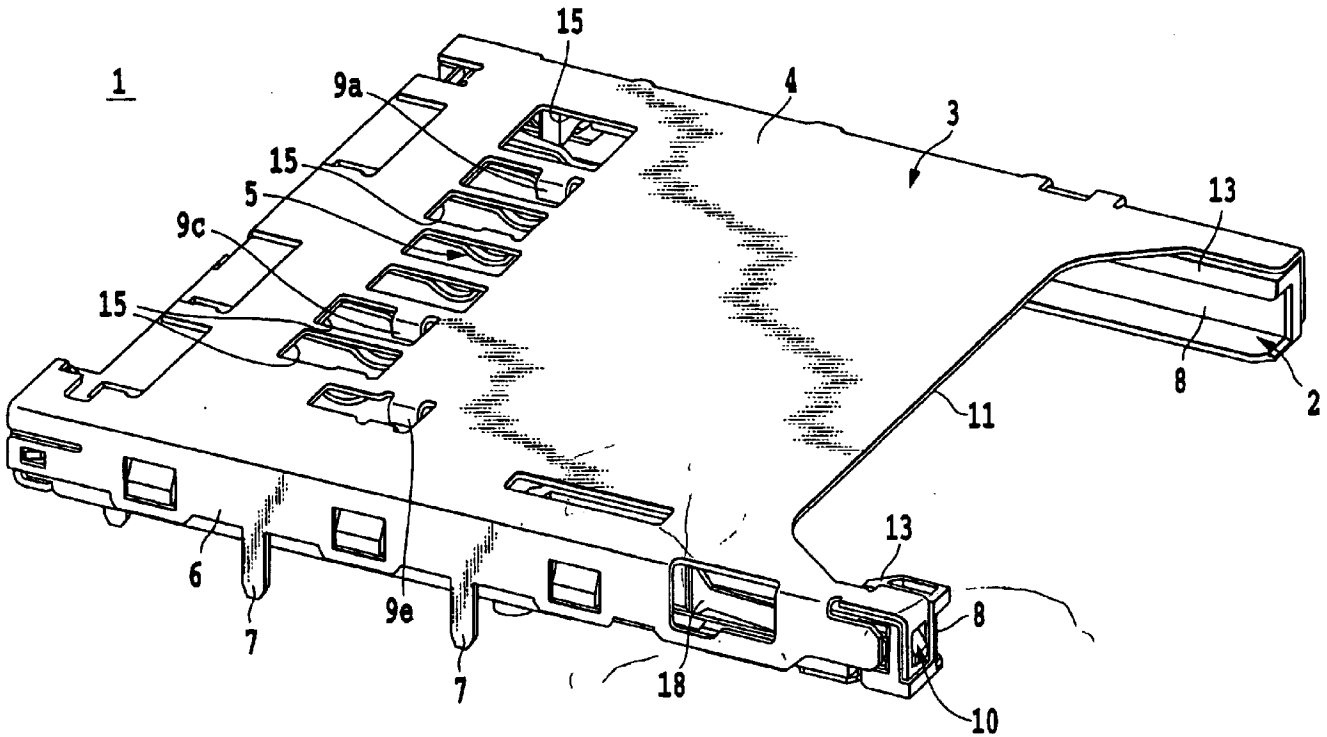
FIG. 1 is a perspective view of a card connector according to the present invention.
Figure 2:
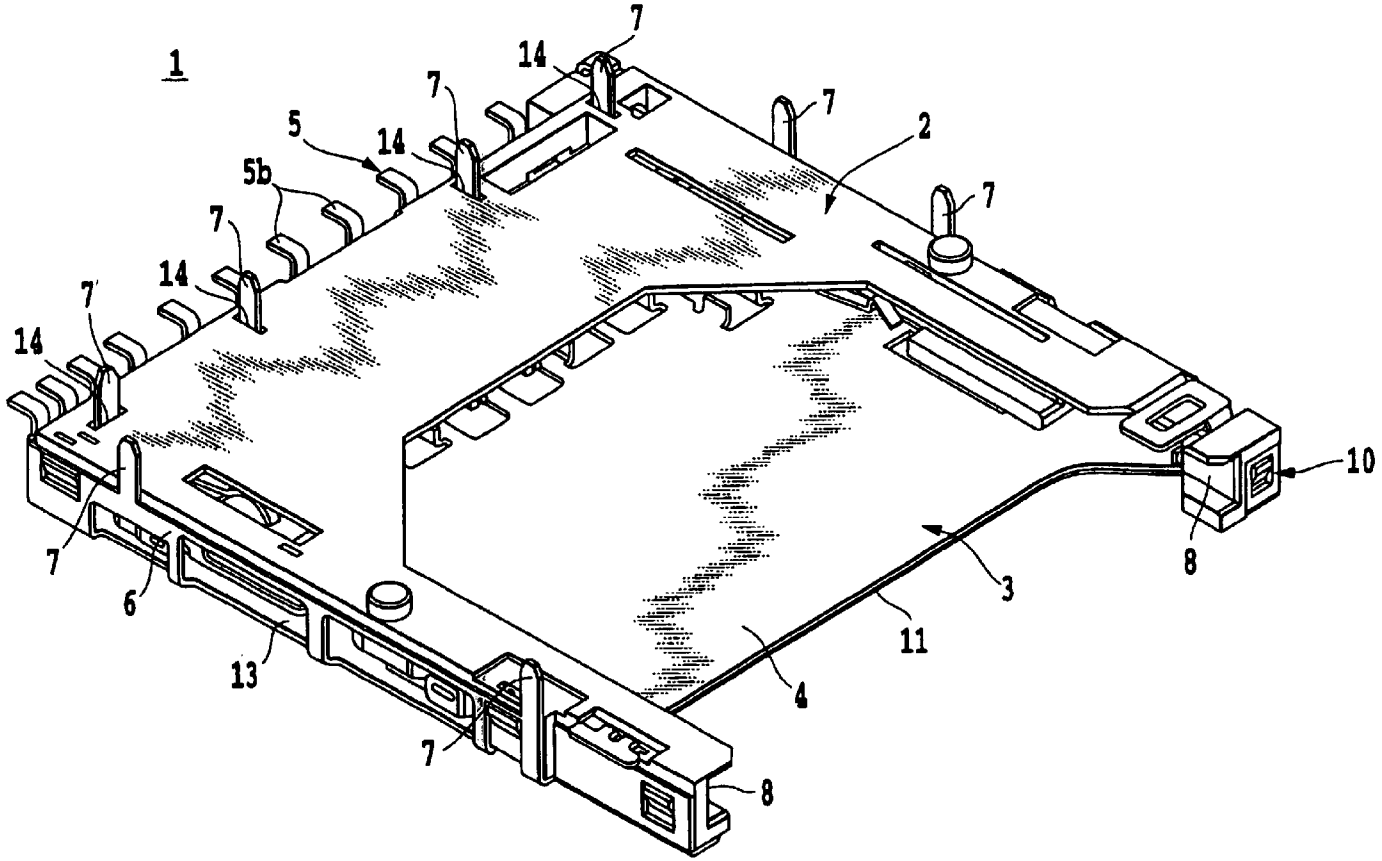
FIG. 2 is a perspective view of the card connector according to the present invention shown in FIG. 1 as seen from the back side.
Figure 3:
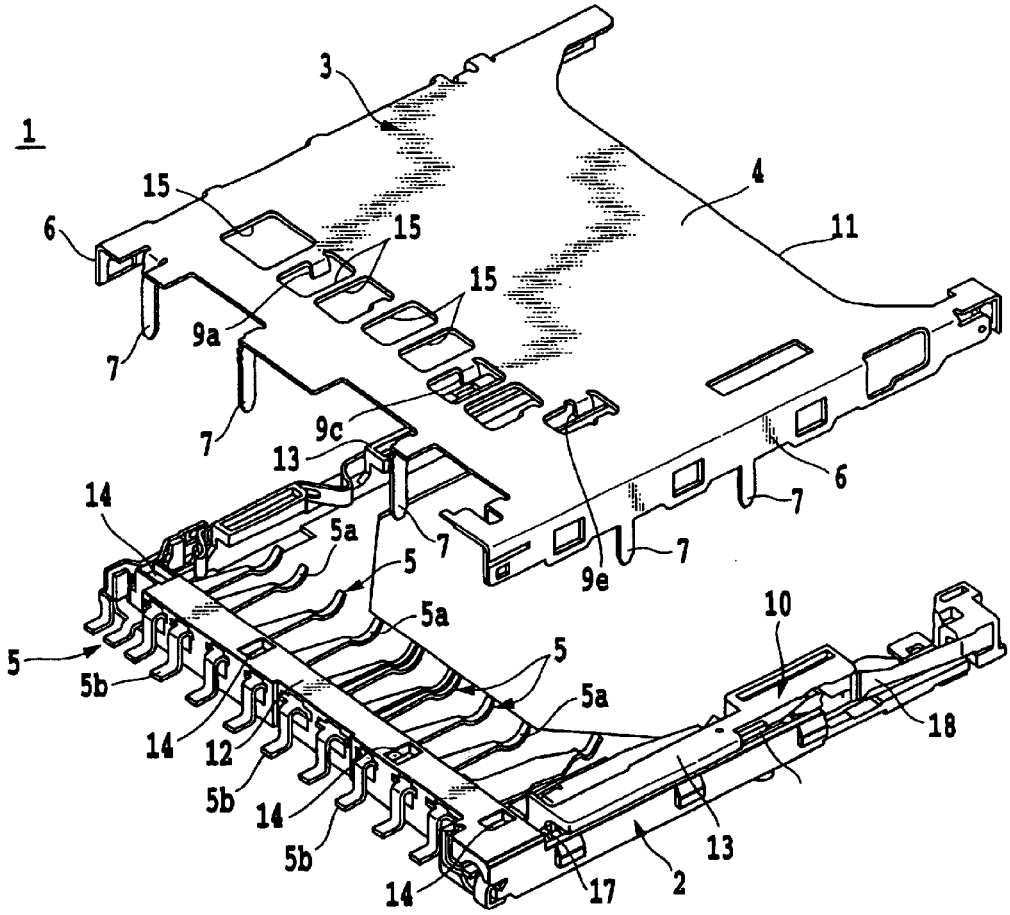
FIG. 3 is a perspective view of the card connector shown in FIG. 1, disassembled into a base and a metal sheet cover.
Figure 4:
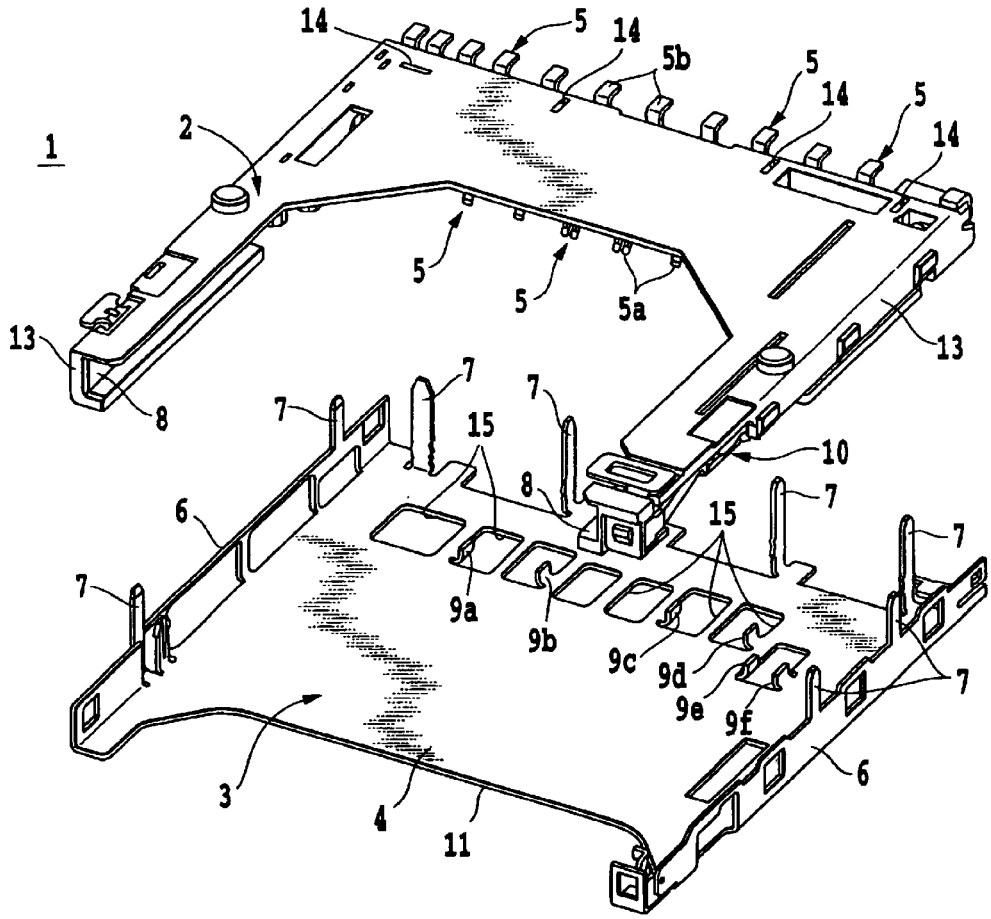
FIG. 4 is a perspective view of the card connector according to the present invention shown in FIG. 3, disassembled into the base and the metal sheet cover, as seen from the back side.
Figure 5:
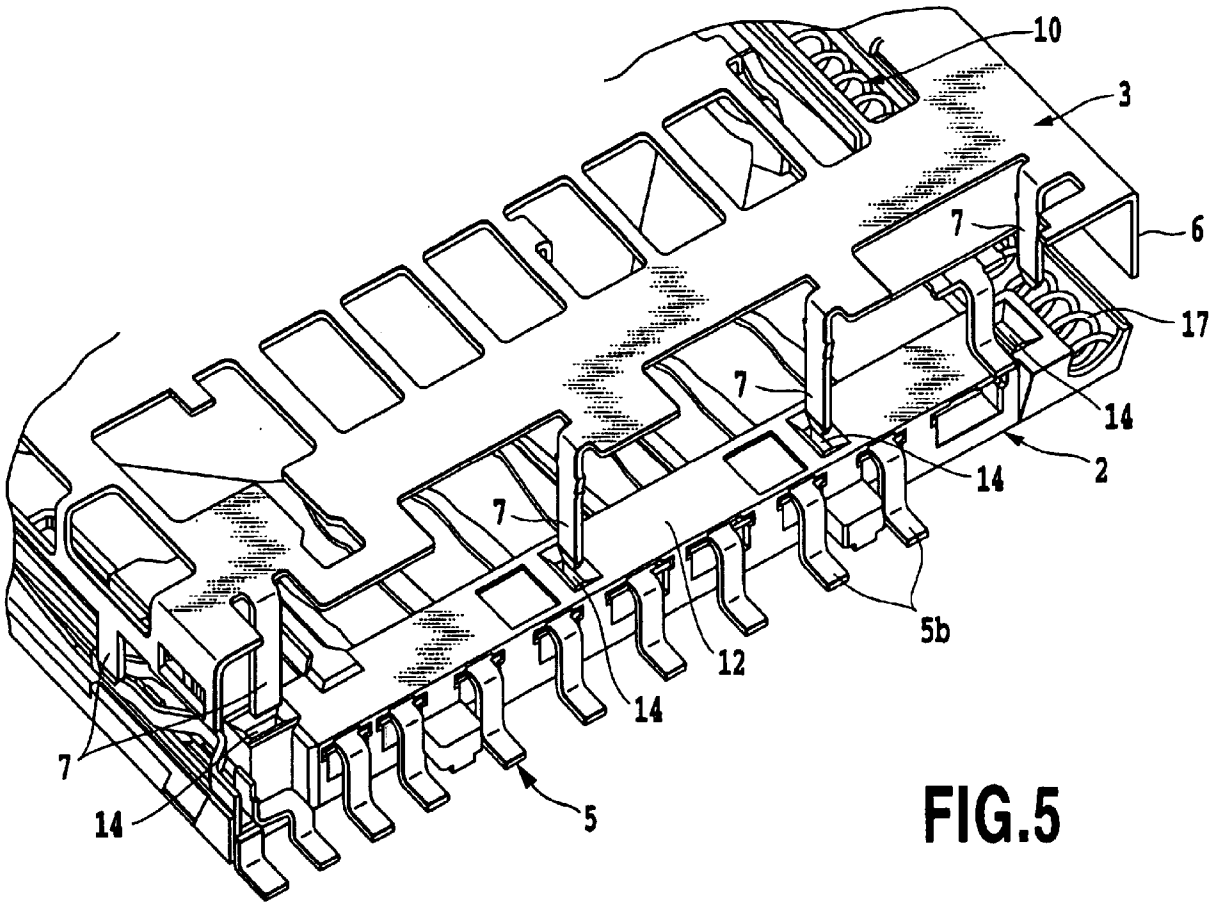
FIG. 5 is a partial perspective view of the terminal portions of the card connector according to the present invention when the base and the metal sheet cover of the card connector are assembled to each other.
Figure 6:
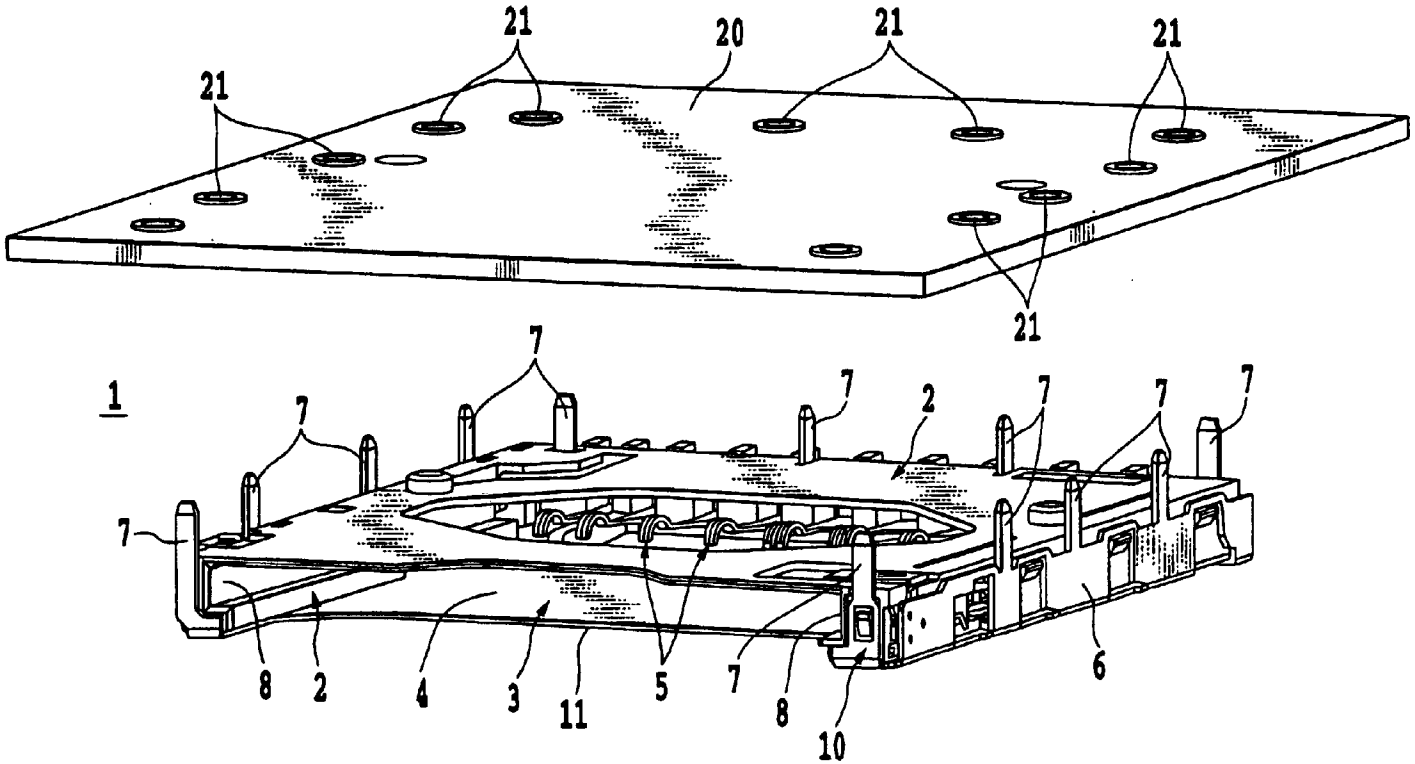
FIG. 6 is a perspective view showing a state before a printed circuit board is mounted to the card connector according to the present invention.
Figure 7:
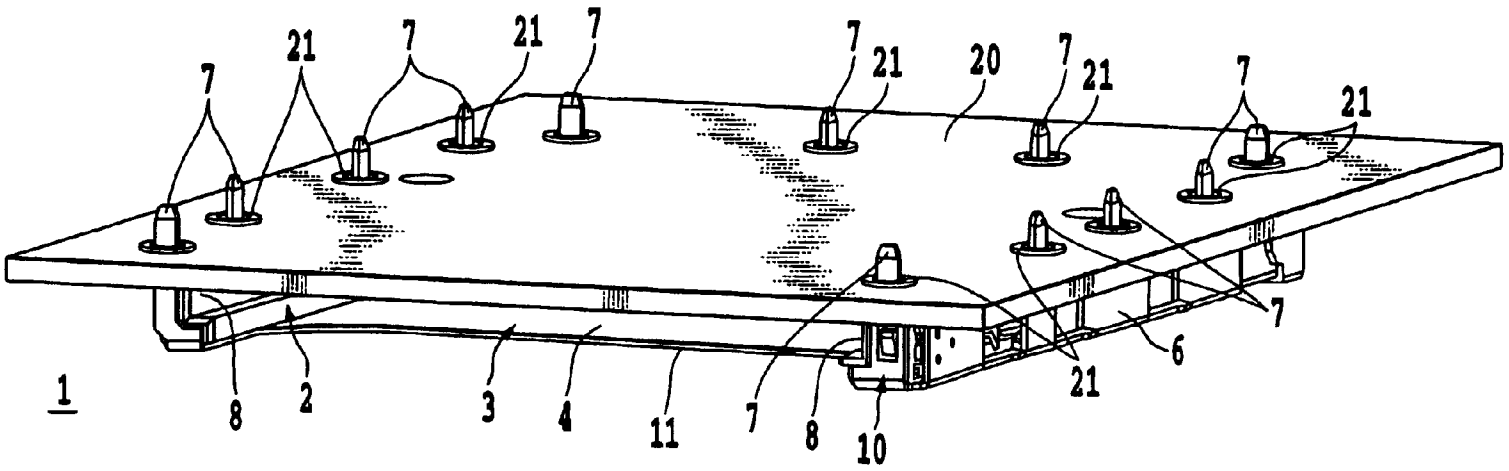
FIG. 7 is a perspective view showing a state after the printed circuit board is mounted to the card connector according to the present invention.

FIGS. 1 to 7 illustrate an embodiment of a card connector according to the present invention, wherein FIG. 1 is a perspective view of a card connector according to the present invention, FIG. 2 is a perspective view of the card connector according to the present invention shown in FIG. 1 as seen from the back side, FIG. 3 is a perspective view of the card connector shown in FIG. 1, disassembled into a base and a metal sheet cover, FIG. 4 is a perspective view of the card connector shown in FIG. 3, disassembled into the base and the metal sheet cover, as seen from the back side, FIG. 5 is a partial perspective view of connector terminal portions when the base and the metal sheet cover of the card connector are assembled to each other, FIG. 6 is a perspective view showing a state before a printed circuit board is mounted to the card connector according to the present invention, and FIG. 7 is a perspective view showing a state after the printed circuit board is mounted to the card connector according to the present invention.

As shown in FIGS. 1 to 5, the card connector 1 according to the present invention is constructed as a hollow and flat housing formed of a base 2 and a sheet metal cover 3 in combination with the base 2, one end of which is open to define a card entrance 11 and the other end is closed to have a plurality of contacts 5 to be electrically connected to the IC card, SD card or SIM card (not shown).

In the same manner as a general card, the IC card, SD card or SIM card used for the card connector 1 according to the present invention has a plurality of pads aligned at one end thereof, and a cut section is provided at one corner of the end, if required. Stepped shoulders are provided on opposite sides of the card to be fitted with guide grooves 8 of the card connector 1 so that the card is smoothly guided.

The card connector 1 according to the present invention has a plurality of projections 9*a*, 9*b*, 9*c*, 9*d*, 9*e* and 9*f* for preventing the card, SD card or SIM card from being erroneously, for example, oppositely inserted when the card is inserted from the card entrance 11, and an ejector mechanism 10 for smoothly withdrawing the inserted card.

As shown in the drawings, the base 2 of the card connector 1 according to the present invention is molded with an insulating material such as a suitable synthetic resin, and combined with a sheet metal cover 3 to form a hollow and flat housing, into which the IC card, SD card or SIM card is inserted. The ejector mechanism 10 is provided with the base 2 of the insulating material along one side thereof so that the card can be smoothly withdrawn from the card connector 1.

For example, the ejector mechanism 10 includes an operating member 16 mounted in a hollow elongate holder wall defined in one of lateral walls 13 of the base 2 in a slidable manner, a spring 17 such as a coil spring for elastically biasing the operating member 16 and a latch member 18 for latching the operating member 16 so that when the latch member 18 is released, an elastic force stored in the spring 17 pushes the operating member 16 to eject the card. The ejector mechanism 10 is not limited to such a structure but may be any of similar type mechanisms.

The sheet metal cover 3 of the card connector according to the present invention includes a cover body 4 formed of a thin metallic plate such as stainless steel by a blanking or a pressing to have the illustrated shape in which the card entrance 11 is formed on the front side and a pair of lateral walls 6, 6 are on the right and left sides. On the edges of the lateral walls 6, 6 and on the rear side of the sheet metal cover 3, a plurality of pin-like elongate terminal members 7 are provided to extend generally vertical to a flat portion defining the cover body 4 of the sheet metal cover 3. These pin-like elongate terminal members 7 extend to have a sufficient length as illustrated and are press-fit into holes 14 having a size corresponding thereto provided in an innermost end wall 12 of the base 2 of insulating material. Accordingly, since the pin-like elongate terminal members 7 of the sheet metal cover 3 are press-fit into the holes 14 of the base 2, the base 2 and the sheet metal cover 3 are assembled integral with each other with no looseness, as well as there happens no deformation in the end wall 12 and lateral walls 13 of a molded portion of the base 2. The elongate terminal members 7 of the sheet metal cover 3 are not necessarily attached to the holes 14 of the molded portion of the base 2 by the press-fit as described above, but may be more loosely attached unless there is a backlash between the both. Further, if the hole 14 of the base 2 has a taper in an inlet thereof, the elongate terminal member 7 is more easily guided into the hole 14.

Openings 15 for a plurality of contacts 5 are provided on the rear end of the sheet metal cover 3. Particularly, as shown in FIG. 4, projections 9*a*, 9*b*, 9*c*, 9*d*, 9*e* and 9*f* are bent from sides of the openings 15 to extend inward. A portion of the opening 15 in which the projection 9*a*, 9*b*, 9*c* or 9*d* is provided and a position of the opening 15 in which the projections 9*e* and 9*f* are provided are optionally selectable.

Thereby, the card such as an IC card, SD card or SIM card is inserted into the card connector 1 through the card entrance 11 formed on the front side of the card connector 1, and can be withdrawn therefrom by actuating the operating member 16 due to the bias of the spring 17 upon the release of the latching action of the latch member 18 in the ejector mechanism 10.

While the projections 9*a* to 9*f* are bent in the longitudinal direction of the card connector 1, that is, parallel to the card-inserting direction, they may be bent in the lateral direction of the card connector 1, that is, orthogonal to the card-inserting direction. Bending direction of the projections 9*a* to 9*f* are not limited to the directions as described above, but can be bent to any directions. Also, the number of the projections 9*a*, 9*b*, 9*c*, 9*d*, 9*e* and 9*f* should not be limited to the illustrated one but may be optionally selected, as required. An end surface and a side surface of the projection 9*a* to 9*f* or all of the outer circumference thereof may be integrally covered with insulating material such as synthetic resin, for example, by an outsert or insert molding if necessary.

Furthermore, the plurality of contacts 5 are provided on the rear side of the card connector 1 and brought into contact with pads of the card such as an IC card, SD card or SIM card inserted into the card connector 1 to be electrically connected thereto. Via the contact 5, the card is connected to a printed circuit base (not shown) of an electronics apparatus.

That is, as shown in FIG. 3, the contact 5 is provided at a tip end thereof with an arcuate resilient contact piece 5*a* brought into contact and connected with the pad of the IC card, SD card and SIM card and at a rear end thereof with a terminal 5*b* to be properly connected to a printed circuit base of the electronics apparatus or information terminal equipment by a soldering or others.

According to the card connector 1 of the present invention, the card such as an IC card, SD card or SIM card, for example, of a double-thickness type may be usable. When such a card is inserted in a normal state into the card connector 2 from the card entrance 11, the pads of the card are properly aligned with the contacts 5 to position the resilient contact pieces 5*a* of the contacts on the pads of the card, resulting in the favorable connection.

In this case, if the tip end of the card is inserted, the resilient contact piece 5*a* of the contact 5 is pushed upward as seen in FIG. 3 and elastically deformed. Subsequently thereto, the resilient contact piece is brought into contact with the pad of the card with a proper elastic contact pressure to result in the favorable connection.

Thereby, the card is favorably electrically connected to the printed circuit base of the electronics apparatus via the pad and the contact 5. The projections 9*a* to 9*f* are favorably provided at positions of ground pads of the card, that is, positions in a card pad having no circuit. Heights of the projections 9*a* to 9*f* of the sheet metal cover 3 can be maintained at a suitable level. In other words, since the card must be prevented from being inserted deeper than a certain length by the projections 9*a* to 9*f* extending from the sheet metal cover 3 when the card is erroneously inserted in the card connector 1 of a reverse type, a certain height of the projection is necessary. In this regard, if the height of the projection is too high, sometimes it may be brought into contact with the pad of the card to cause the short-circuit accident resulting in the damage of the circuit of the card. Thereby, the projection 9*a* to 9*f* is preferably provided in the ground portion of the pad while avoiding the circuit portion of the pad so that even if the projection 9*a* to 9*f* of the sheet metal cover 3 is brought into contact with the pad of the card, there is no damage to the card because the no circuit exists in the ground portion.

Even if the card is erroneously inserted so that the rear end is directed forward, the rear end of the card abuts either of the projection 9*a* to 9*f* effectively operating as a stopper whereby the erroneous advance of the card is properly inhibited.

As described above, according to the card connector 1 of the present invention, a hollow flat housing is defined by the base 2 and the sheet metal cover 3 combined therewith. An erroneous-insert preventing means can be provided by the projections 9*a* to 9*f* formed by simply bending the sheet metal cover 3 inward, which means protects the resilient contact piece 5*a* of the contact 5 from buckling, is free from the short-circuit accident and assuredly prevents the card from erroneously being inserted so that the rear end thereof is directed forward. Further, the card connector 1 of the present invention is formed by combining the base 2 of the insulating material with the sheet metal cover 3 made of a then metal plate material, whereby it is possible to reduce a thickness and thus a height of the card connector 1 its own, and to improve a strength thereof.

An example in which the card connector according to the present invention thus structured is mounted to a printed circuit board is illustrated in FIGS. 6 and 7, wherein FIG. 6 is a perspective view showing a state before the printed circuit board is mounted to the card connector according to the present invention, and FIG. 7 is a perspective view showing a state after the printed circuit board is mounted to the card connector according to the present invention.

As illustrated in FIGS. 6 and 7, the printed circuit board 20 to which the card connector 1 according to the present invention is mounted has a plurality of holes 21 at necessary positions in accordance with the required circuit structure. Through these holes 21, the terminal members 7 of the card connector 1 of the present invention are inserted as DIP terminals. The terminal members 7 are inserted as DIP terminals into the holes 21 of the printed circuit board 20 while tip ends thereof are projecting outside the holes. The projected tip ends of the terminal member 7 are preferably bonded to the printed circuit board 20 with solder or lead-free material such as tin-copper or tin-silver-copper.

The card connector 1 according to the present invention thus structured includes the base 2 and the sheet metal cover 3. The pin-like elongate terminal members 7 extend from the end wall and the lateral walls 6 of the sheet metal cover 3 so that the base 2 and the sheet metal cover 3 are integrally combined with each other thereby. Thus, the card connector for various electronics apparatuses or information terminal devices such as a portable phone, telephone, PDA, portable audio or camera are obtainable, which has a rigid structure durable against an impact imparted when the housing of the apparatus or equipment falls, as well as achieving a small height to satisfy the market demand.

The present invention has been described in detail with respect of the preferred embodiment, and it will now be apparent from foregoing to those skilled in the art that changes and modifications may be made without departing from the invention in its broader aspects, and it is the intention, therefore, in the appended claims to cover all such changes and modifications as fall within true spirit of the invention.

What is claimed is:

1. A card connector comprising:

a base; and a sheet metal cover combined with the base to form a flat hollow housing, the housing being configured to receive a card, wherein a plurality of pin-like elongate terminal members are formed on the sheet metal cover, wherein the base comprises a first portion and a second portion, the first portion of the base overlapping the card when the card is inserted into the housing, and the second portion of the base being spaced from the first portion of the base, wherein a plurality of holes are provided in the second portion of the base, and wherein the elongate terminal members of the sheet metal cover are inserted into each of the plurality of holes to combine the base and the sheet metal cover with each other.

2. A card connector in accordance with claim 1, wherein the sheet metal cover includes a flat cover body and lateral walls formed by bending opposite sides of the cover body, wherein the elongate terminal members extend outward from an end and the lateral walls of the sheet metal cover.

3. A card connector in accordance with claim 1, further including a printed circuit board wherein the elongate terminal members are mounted to the printed circuit board to pass therethrough as DIP terminals, tip ends of which project outside the printed circuit board and are bonded by solder or lead-free material.

4. A card connector in accordance with claim 1, wherein the card has edges, the card connector further comprising guide grooves configured to guide the card by the edges of the card for smooth insertion of the card.

5. A card connector in accordance with claim 1, wherein the sheet metal cover comprises projections configured to contact the card and prevent the card from erroneous insertion.

6. A card connector in accordance with claim 5, wherein the projections are formed by bending a part of the sheet metal cover.

7. A card connector in accordance with claim 1, further comprising an ejector mechanism for withdrawing the card from the housing.

8. A card connector in accordance with claim 1, wherein the base is molded with an insulating material.

9. A card connector in accordance with claim 8, wherein the insulating material is a synthetic resin.

10. A card connector in accordance with claim 6, wherein the sheet metal cover comprises openings, and wherein the projections are bent from sides of the openings.

11. A card connector in accordance with claim 1, wherein the elongate terminal members of the sheet metal cover are press fit into the plurality of holes.

12. A card connector in accordance with claim 1, wherein the plurality of holes have tapered inlets configured to easily guide the elongate terminal members into the holes.

13. A card connector comprising:

a base; and a sheet metal cover combined with the base to form a flat hollow housing, the housing being configured to receive a card, wherein a plurality of pin-like elongate terminal members are formed on the sheet metal cover, wherein the base comprises a first portion and a second portion, the first portion of the base overlapping the card when the card is inserted into the housing, and the second portion of the base being spaced from the first portion of the base, wherein a plurality of holes are provided in the second portion of the base, and wherein the elongate terminal members of the sheet metal cover are press fit into each of the plurality of holes to combine the base and the sheet metal cover with each other.

14. A card connector in accordance with claim 13, wherein the sheet metal cover includes a flat cover body and lateral walls formed by bending opposite sides of the cover body, wherein the elongate terminal members extend outward from an end and the lateral walls of the sheet metal cover.

15. A card connector in accordance with claim 13, further including a printed circuit board wherein the elongate terminal members are mounted to the printed circuit board to pass therethrough as DIP terminals, tip ends of which project outside the printed circuit board and are bonded by solder or lead-free material.

16. A card connector in accordance with claim 13, wherein the card has edges, the card connector further comprising guide grooves configured to guide the card by the edges of the card for smooth insertion of the card.

17. A card connector in accordance with claim 13, wherein the sheet metal cover comprises projections configured to contact the card and prevent the card from erroneous insertion.

18. A card connector in accordance with claim 17, wherein the projections are formed by bending a part of the sheet metal cover.

19. A card connector in accordance with claim 13, further comprising an ejector mechanism for withdrawing the card from the housing.

20. A card connector in accordance with claim 13, wherein the base is molded with an insulating material.

21. A card connector in accordance with claim 20, wherein the insulating material is a synthetic resin.

22. A card connector in accordance with claim 18, wherein the sheet metal cover comprises openings, and wherein the projections are bent from sides of the openings.

23. A card connector in accordance with claim 13, wherein the plurality of holes have tapered inlets configured to easily guide the elongate terminal members into each of the plurality of holes.

24. A card connector in accordance with claim 1, wherein a plurality of projections are formed on the sheet metal cover to inhibit an erroneous advance of the card.

25. A card connector in accordance with claim 13, wherein a plurality of projections are formed on the sheet metal cover to inhibit an erroneous advance of the card.

* * * * *